US008528144B2

(12) United States Patent
Oselinsky et al.

(10) Patent No.: US 8,528,144 B2
(45) Date of Patent: Sep. 10, 2013

(54) AR15/M16 RIFLE VARIANT BOLT CLEANING AND POLISHING TOOL

(76) Inventors: Gregory Oselinsky, Morgan Hill, CA (US); Gary Bain, Sunnyvale, CA (US)

( * ) Notice: Subject to any disclaimer, the term of this patent is extended or adjusted under 35 U.S.C. 154(b) by 400 days.

(21) Appl. No.: 12/879,759

(22) Filed: Sep. 10, 2010

(65) Prior Publication Data

US 2011/0113669 A1 May 19, 2011

Related U.S. Application Data

(60) Provisional application No. 61/241,495, filed on Sep. 11, 2009.

(51) Int. Cl.
*A46B 15/00* (2006.01)

(52) U.S. Cl.
USPC ..... 15/105

(58) Field of Classification Search
USPC ..... 15/93.1, 105, 104.001; 470/207, 470/186, 190; 408/199, 221, 227
See application file for complete search history.

(56) References Cited

U.S. PATENT DOCUMENTS 7,418,756 B1 * 9/2008 Ortega ..... 15/104.001
7,644,529 B2 * 1/2010 Hopper et al. ..... 42/90

* cited by examiner

*Primary Examiner* — Robert Scruggs

(57) ABSTRACT

An AR-15/M-16 rifle variant bolt cleaning and polishing tool comprising three pieces designed for scraping the carbon build up off of a dirty rifle bolt, then polishing the residual carbon completely off the bolt tail. The scraping is accomplished by means of a scraping blade with a radius that matches the bolt tail and rotating the bolt tail against this blade while applying pressure. The polishing is accomplished by inserting a polishing pad between the polishing arm and the main body of the tool and then applying pressure to the polishing arm creating torque to polish off residual carbon.

4 Claims, 1 Drawing Sheet

AR15/M16 RIFLE VARIANT BOLT CLEANING AND POLISHING TOOL

CROSS REFERENCE

The present application claims priority from provisional patent application 61/241,495, filed on Sep. 11, 2009 the contents of which are incorporated by reference in their entirety.

BACKGROUND OF THE INVENTION

1. Field of Endeavor

The present disclosure relates to the cleaning of the bolt used in semi-automatic and fully automatic rifle variants such as those rifles styled after the direct gas impingement of the AR-15 or M-16 rifle.

2. Description of the Prior Art

The function of the AR-15/M-16 rifle and its variants utilizes a method of direct gas impingement where the expended gas of a fired cartridge is captured and funneled back into the rifle to complete the cycle of operation. By doing so, gas is directed onto the bolt tail where carbon from the gas accumulates. This carbon builds as the rifle is repeatedly tired and can cause stoppages and malfunctions within the rifle and the cycle of operation if not cleaned from the bolt tail.

Other methods for cleaning this carbon from the bolt tail are generally ineffective, time consuming and laborious, and include wiping with a cloth, the use of chemical solvents, scraping with non-specific tools such as screwdrivers, knives, dental picks, and expended cartridge casings. Further, none of these methods completely remove the carbon from the bolt tail.

U.S. Pat. No. 7,644,529 B2 to Hopper et al. issued Jan. 12, 2010 describes a simplified tool that scrapes a portion of the carbon off the rifle bolt tail, but does not completely remove the carbon from the rifle bolt tail or assist in the continued maintenance and future cleanings by removing all of the carbon from the rifle bolt tail thus limiting the carbon build up

BRIEF SUMMARY OF THE INVENTION

The present invention provides a bolt cleaner and polisher for automatic and semi-automatic rifles. Various embodiments of the present invention comfortably fit in one hand for ease of use, while a pivot arm allows for enough torque to effectively clean the rifle. Embodiments of the present invention are constructed for lasting durability and resistance to chemical solvents. A scraper blade is preferably laser cut to the same radius as the rifle bolt tail and has four scraping surfaces. This tool will remove the carbon build up from the bolt tail in a matter of seconds. The unique polisher ensures that the carbon on the bolt tail is removed and helps prevents residual build up on the bolt tail.

BRIEF DESCRIPTION OF THE DRAWINGS

1.

DETAILED DESCRIPTION OF THE INVENTION

Figure 1:
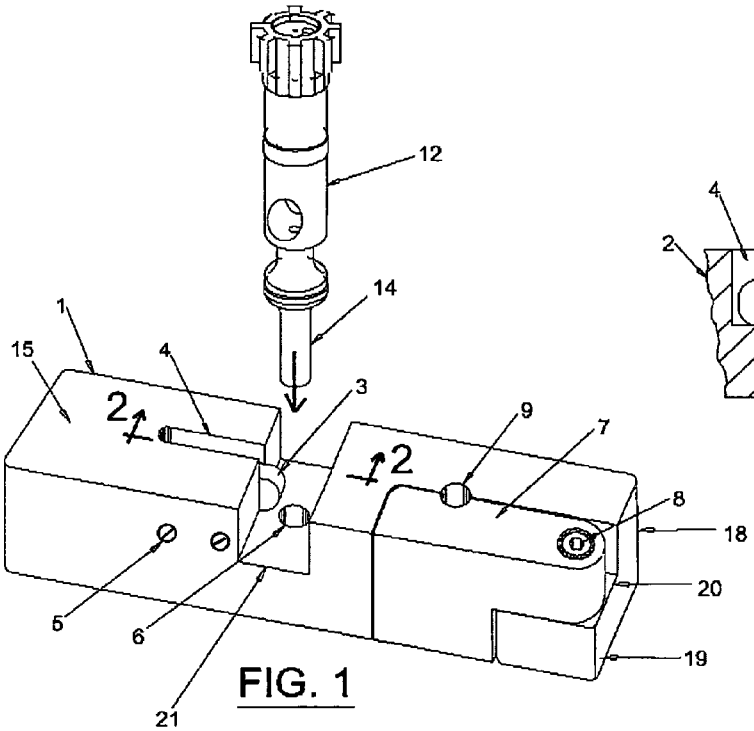
FIG. 1 is an overall top view of the rifle bolt cleaning and polishing tool with the polishing arm dosed.
2.
Figure 2:
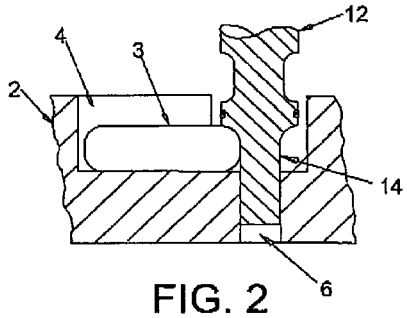
FIG. 2 is a detail view of the rifle bolt tail in contact with the scraping blade.
3.
Figure 3:
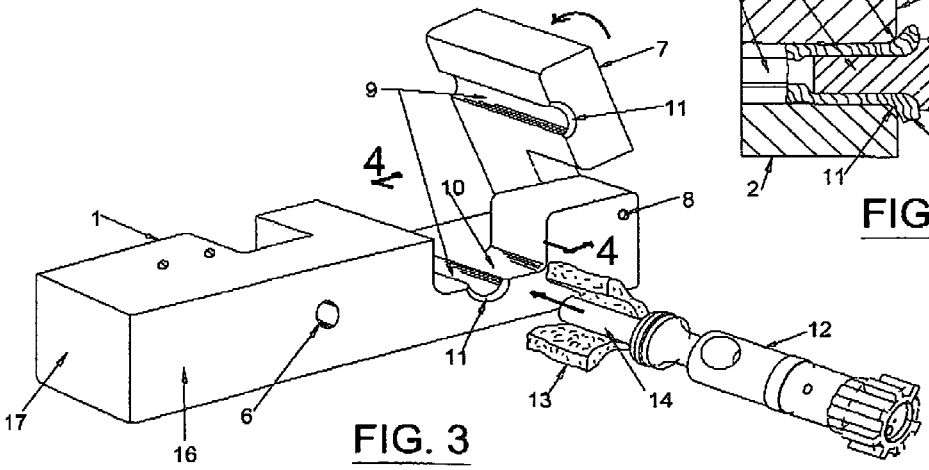
FIG. 3 is an overall view of the bottom of the rifle bolt cleaning and polishing tool with the polishing arm open, polishing pad, and the rifle bolt.
4.
Figure 4:
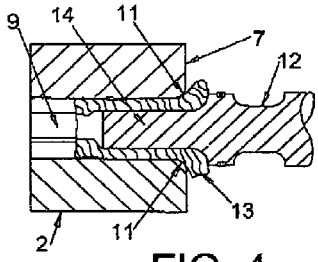
FIG. 4 is a detail view of the polishing arm in the closed position with the rifle bolt inserted with a polishing pad.

With respect to the present discussion, the following reference numbers

REFERENCE NUMBERS

1. Rifle bolt cleaning tool (assembled)
2. Tool body
3. Scraper blade
4. Scraper blade channel
5. Scraper blade set screws
6. Scraper guide hole
7. L-shaped polishing arm
8. Polishing arm pivot screw
9. Polishing arm guide hole
10 Polishing pad capture area
11. Polishing arm guide hole radius
12. Rifle bolt
13. Polishing pad
14. Rifle bolt tail
15. Upper surface of tool body
16. Lower surface of tool body
17. First square end
18. Second L-shaped end
19. Foot portion
20. Upper surface of foot
21. U-shaped channel While the present disclosure discusses the user of a bolt cleaning and polishing tool for an AR-15/M-16 rifle variant, those skilled in the art will recognize that it can be used on other types of rifles and rifle variants. The AR-15/M-16 rifle variant bolt cleaning and polishing tool, according to the present disclosure, is a gun cleaning product that is efficient and useful. This invention was made with the user in mind with the goal being making gun cleaning easier Carbon build up on an AR-15/M-16 variant rifle bolt tail can be a challenge for even the experienced gun cleaner. The present disclosure provides a solution for cleaning the carbon off the AR-15/M-16 bolt tail in just a matter of seconds. The cleaner and polisher strips away the carbon from the bolt tail surface. This eliminates the need for any messy solvents to clean the bolt. Further, the present invention is designed to be used without any solvents. This tool balances the importance of weapon maintenance and function with trying to reduce the amount of time needed to clean the rifle. Proper cleaning of the carbon build up from the bolt tail will help prevent a catastrophic failure caused by an interruption of the gas flow through the weapon. Using this bolt cleaning and polishing tool will help prevent the continuing build-up of carbon and make cleaning easier each time the tool is used. The present invention eliminates the need for many different makeshift tools and chemicals to remove the carbon from the rifle bolt tail. The present invention helps ensure proper maintenance and function of the rifle.

The bolt cleaner and polisher 1 was designed with the user in mind. This invention comfortably fits in one hand for ease of use, while the L-shaped polishing arm 7 allows plenty of torque for superior cleaning. The tool 1 is constructed for lasting durability and resistance to chemical solvents. The scraper blades is laser cut to the same radius as the rifle bolt tail 14 and has four scraping surfaces. This tool 1 will remove the carbon build up from the AR-15/M-16 rifle variants bolt tail 14 in a matter of seconds. The unique polisher 7 ensures that every last bit of carbon is removed and helps prevents residual build up on the bolt tail 14.

FIG. 1 is an overall top view of the bolt cleaner and polisher tool 1 in its assembled condition, according to one illustrative embodiment. As illustrated in FIG. 1, scraper blade 3 is locked into scraper blade channel 4 cut into the upper surface of the tool body 21 with set screws s adjacent to the U-shaped channel 21. The L-shaped polishing arm 7 is attached to tool body 2 with a pivot screw 8 at the L-shaped end 18. The tool body 2 and the L-shaped polishing arm 7 are preferably constructed of a durable material, such as metal and plastic. However, those skilled in the art will recognize that other materials can be used.

In one embodiment, blade 3 is constructed of a metal hard enough to hold a laser cut edge and scrape off the built up carbon on the rifle bolt tail 24 without cutting into or damaging it. The scraper blade channel 4 cut into the upper surface of the tool body is slightly longer than the length of the scraper blade 3, slightly wider than the width of the scraper blade 3, and slightly taller than the height of the scraper blade 3. This arrangement helps keep the scraper blade 3 beneath the surface level of the upper surface of the tool body 15. The scraper blade 3 is aligned as to allow the rifle bolt tail 14 to contact the scraper blade 3 at the same radius when the rifle bolt tail 14 is inserted into the scraper guide hole 6. The L-shaped polishing arm 7 is the same height as the tool body 2 and is cut across the middle of the polishing arm guide hole 9 with half of the polishing arm guide hole 9 on the L-shaped polishing army and half of the polishing arm guide hole 9 on the tool body 2. The start n of the polishing arm guide hole 9 is cut to the radius of the rifle bolt tail 14. The L-shaped polishing arm 7 is attached to the tool body 2 with a pivot screw 8 to allow the L-shaped polishing arm 7 to pivot into an open position to accept the polishing pad 13 in the polishing pad capture area 10. In one embodiment the open position is 180 degrees.

To clean the carbon off the rifle bolt tail 14, first the user inserts the rifle bolt tail 14 into the scraper guide hole 6 and makes contact between the rifle bolt tail 14 and the scraper blade 3. Next, the user pushes the rifle bolt 12 down onto the scraper blade 3 while rotating the rifle bolt 12 clockwise and counterclockwise until the majority of the carbon is removed from the rifle bolt tail 14 by the scraper blade 3. Then the user opens the L-shaped polishing arm 7 and places a portion of polishing pad 13 into the polishing pad capture area 10. The user leaves a portion of the polishing pad 13 extending out past the edge of the lower surface of tool body 16 and the start of the polishing arm guide hole 9 where the radius 11 is cut. This allows the polishing pad 13 to flatten itself onto the radius of the rifle bolt tail 14 and polish off the carbon. Next the user places the rifle bolt tail 14 onto the tool body 2 side of the polishing arm guide hole 9 with the cone portion at the radius 21 cut into the edge of the guide hole 9. Once the rifle bolt tail 14 is placed in this position, the user closes the L-shaped polishing arm 7 causing the polishing pad 13 to fold in half over the rifle bolt tail 14, enclosing the rifle bolt tail 14 in the L-shaped polishing arm 7, wrapped with the polishing pad 13. Finally pressure is applied to keep the L-shaped polishing arm 7 dosed and to create torque, while rotating the rifle bolt 12 clockwise and counterclockwise until the residual carbon is polished off the rifle bolt tail 14.

This entire cleaning process, using this invention, takes only a few seconds, requires no additional tools or chemical solvents, and ideally completely removes the carbon from the rifle bolt tail.

In conclusion the present disclosure is directed to a bolt cleaning and polishing tool comprising: Two pieces of material that are joined by a pivot screw enabling one piece of material to pivot outward 180 degrees, wherein a guide hole, cut into the body of each piece so half of the hole is in each piece, holds the rifle bolt in place during the polishing portion of the cleaning process; and a cleaning chamber cut out in the non-pivoting piece, wherein a scraping blade is affixed; and a guide hole in the non-pivoting piece that allows the rifle bolt to lower onto the scraping blade and contact is made between the radius of the bolt tail and the scraping blade.

Although the present invention has been described with reference to preferred embodiments, workers skilled in the art will recognize that changes may be made in form and detail without departing from the spirit and scope of the invention.

The invention claimed is:

1. A bolt cleaning and polishing tool comprising:

a tool body formed from a first material and including an upper surface, a lower surface, a first square end and a second L-shaped end formed opposite to said first square end, wherein a foot portion of said second L-shaped end includes an upper surface at a height that is lower than said upper surface of said tool body;

a U-shaped channel extending across the width of said upper surface of said tool body;

a scraper guide hole extending downward from a bottom surface of said U-shaped channel to said bottom surface of said tool body;

a scraper blade channel formed at said upper surface of said tool body and extending perpendicularly from a side wall of said U-shaped channel, said scraper blade channel including a scraper blade locked therein by set screws, wherein a portion of said scraper blade extends into said U-shaped channel, said scraper blade channel being slightly longer than the length of said scraper blade, slightly wider than the width of the scraper blade and slightly taller than the height of said scraper blade;

a L-shaped polishing arm formed from a second material is pivotally mounted to said upper surface of said foot;

a polishing arm guide hole half of which being formed at said upper surface of said tool body extending downward to said bottom surface of said tool body and wherein the other half of said polishing arm guide hole extends downward from said L-shaped polishing arm.

2. The bolt cleaning and polishing tool of claim 1, further comprising:

a polishing pad;

a polishing pad capture area disposed between the first material and the second material, the polishing pad capture area positioning the polishing pad around the bolt tail allowing the second material to apply torque pressure to the rifle bolt tail.

3. The bolt cleaning and polishing tool of claim 1 wherein the second material pivots 180 degrees relative to the first material and closes against the first material to form a guide hole for the AR-15 rifle variant bolt tail.

4. A method of cleaning and polishing carbon from a rifle comprising the apparatus of claim 1, the method comprising:

inserting a rifle bolt tail into said scraper guide hole of said tool body such that contact is made between the rifle bolt tail and said scraper blade;

pushing a rifle bolt down onto said scraper blade;

rotating the rifle bolt for a period of time;

opening said L-shaped polishing arm on said tool body;

placing a polishing pad into a polishing pad capture area;

closing said L-shaped polishing arm over the polishing pad; and rotating the rifle bolt for a period of time while applying torque.

* * * * *